US006202255B1

(12) United States Patent
Sitter

(10) Patent No.: US 6,202,255 B1
(45) Date of Patent: Mar. 20, 2001

(54) HINGE

(75) Inventor: Harald Sitter, Châbles (CH)

(73) Assignee: Charmag S.A., Estavayer-le-Lac (CH)

( * ) Notice: Subject to any disclaimer, the term of this patent is extended or adjusted under 35 U.S.C. 154(b) by 0 days.

(21) Appl. No.: 09/339,833

(22) Filed: Jun. 25, 1999

(30) Foreign Application Priority Data

Jun. 26, 1998 (EP) ..... 98810599

(51) Int. Cl.[7] ..... E05D 7/04
(52) U.S. Cl. ..... 16/242; 16/239
(58) Field of Search ..... 16/242–245, 236, 16/388

(56) References Cited

U.S. PATENT DOCUMENTS 2,373,955 * 4/1945 Fuller ..... 16/245
3,613,150 * 10/1971 Osborn ..... 16/244
4,133,114 * 1/1979 Roach ..... 16/388
4,825,507 * 5/1989 Killingstad ..... 16/241
5,339,493 * 8/1994 MacIntyre ..... 16/238
5,555,605 * 9/1996 Mosher ..... 16/247
5,720,082 * 2/1998 Rossmo ..... 16/244
5,964,011 * 10/1999 Ruston et al. ..... 16/239

* cited by examiner

*Primary Examiner*—Chuck Y. Mah
(74) *Attorney, Agent, or Firm*—Wenderoth, Lind & Ponack, L.L.P.

(57) ABSTRACT

The invention relates to a hinge, in particular for doors, windows and the like, whose hinge wings (1,2), each fastenable on one hinge holder (13, 14), are pivotable relative to one another about an axis of hinge rotation, with at least one of the hinge wings being provided with an adjustment device for adjusting the hinge wing transversely to the axis of hinge rotation. In order to facilitate the adjustability after installation, the adjustment device is formed as an adjusting pin (15) disposed transversely to the axis of hinge rotation (3). Pin ends (15*a*, 15*b*) of the pin (15) are disposed eccentrically with respect to one another and, after installation, are rotatably supported in receiving bores (16, 17) of the hinge wing (1) or of the hinge holder (13) associated with it.

22 Claims, 2 Drawing Sheets

HINGE

BACKGROUND OF THE INVENTION

The invention relates to a hinge.

A hinge is described in EP-OS 791 713. As an adjustment device of the hinge is provided an eccentric case that is rotatably supported in a hinge wing, which guides a hinge bolt forming the axis of rotation of the hinge. The eccentric case is arrestable in any desired rotational position with respect to the hinge wing. By rotating the eccentric case one hinge wing can be adjusted relative to the other hinge wing transversely to the axis of rotation of the hinge.

Such an adjustment device is constructionally relatively expensive since the eccentric case, on the one hand, is rotatably supported in the hinge wing free of play and since, on the other hand, it must serve as play-free support for the hinge bolt. Moreover, actuation of the eccentric case is not simple since it must be rotated in the direction of the axis of rotation of the hinge, which, after installation, is often cumbersome or even entirely impossible.

SUMMARY OF THE INVENTION

An object of the invention is to avoid these disadvantages while creating a hinge of the above cited type whose hinge wings can be adjusted readily and conveniently transversely to the axis of rotation of the hinge even after installation of the hinge. A further object of the invention is to provide a hinge which is simple to produce and cost-effective.

These objects are met through the features of the invention.

While a hinge with a pivot pin directed transversely to the axis of rotation of the hinge is disclosed in EP-OS 0 810 341, the pin is not eccentric and is also not rotatable relative to a hinge wing or to a hinge holder associated with the hinge wing. The pin is also not provided as an adjustment device, but rather as a structure for hindering break-ins while received within a receiving bore in the other hinge holder.

The adjusting pin of the present invention makes possible adjusting the hinge wings transversely to the axis of rotation of the hinge by rotating the adjusting pin about its axis, whereby a lateral displacement of the two hinge wings is brought about. Since the adjusting pin is disposed on the front face of the hinge wing it is also readily accessible after installation. The adjusting pin is producible without especially narrow fabrication and bearing tolerances.

The invention provides further that the adjusting pin is provided between its two pin ends with an annular flange, and that this flange in the installed state is nondisplaceably supported in a bearing depression within a receiving bore of the hinge wing. Consequently, the rotatable adjusting pin is also nondisplaceable in the installed state such that it cannot fall out of the hinge arrangement.

It is herein of advantage if the receiving bore for the adjusting pin is an elongated bore whose major axis is disposed parallel to the axis of the rotation of the hinge. The pin end supported therein can thus move freely in this elongated receiving bore when the adjusting pin is rotated.

A further embodiment of the invention provides that the pin end supported in the elongated receiving bore projects from this receiving bore and is provided with a hexagonal recess or the like for the placement of a turning tool. This allows extremely easy actuation of the adjusting pin.

The adjusting pin according to the invention can also be used as a device hindering break-ins if the pin end supported in the elongated receiving bore projects through a penetration bore of the other hinge wing when the hinge is folded together and, in the installed state, projects into a receiving bore of a hinge holder associated with the other hinge wing. It is herein useful if both the penetration bore and the receiving bore have a diameter approximately equal to the length of the elongated receiving bore along its major axis.

In order to facilitate the adjustment of the hinge wing by virtue of the adjusting pin, the invention provides that the adjusting pin is disposed centrally in the hinge wing when viewed in the direction of the axis of rotation of the hinge.

It is herein of advantage if the hinge wing is provided with elongated bores for receiving fastening screws, whose major axes are directed transversely to the axis of rotation of the hinge.

The adjusting pin according to the invention can also be used with hinges whose hinge wings are adjustable relative to one another in the direction of the axis of rotation of the hinge, wherein an adjustment element intended for this purpose usefully acts upon the hinge wing not provided with the adjusting pin.

BRIEF DESCRIPTION OF THE DRAWINGS

In the following the invention will be explained in further detail in conjunction with two embodiments. In the drawings.

DETAILED DESCRIPTION OF THE INVENTION

Figure 2:
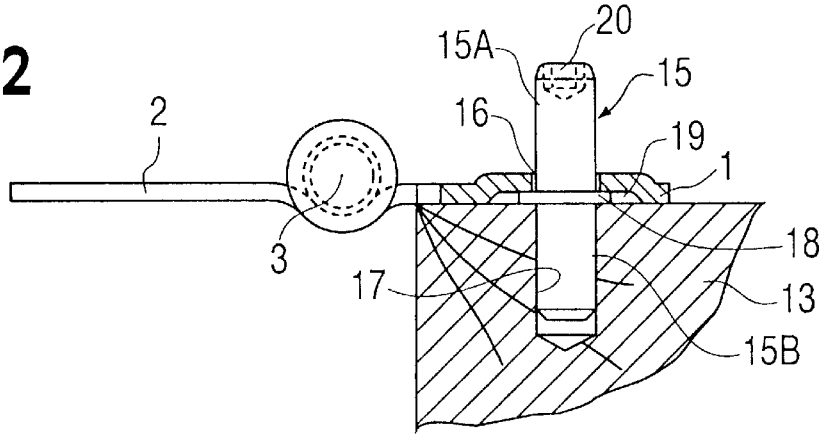
FIG. 2 shows a section along the II—II in FIG. 1.
Figure 1:
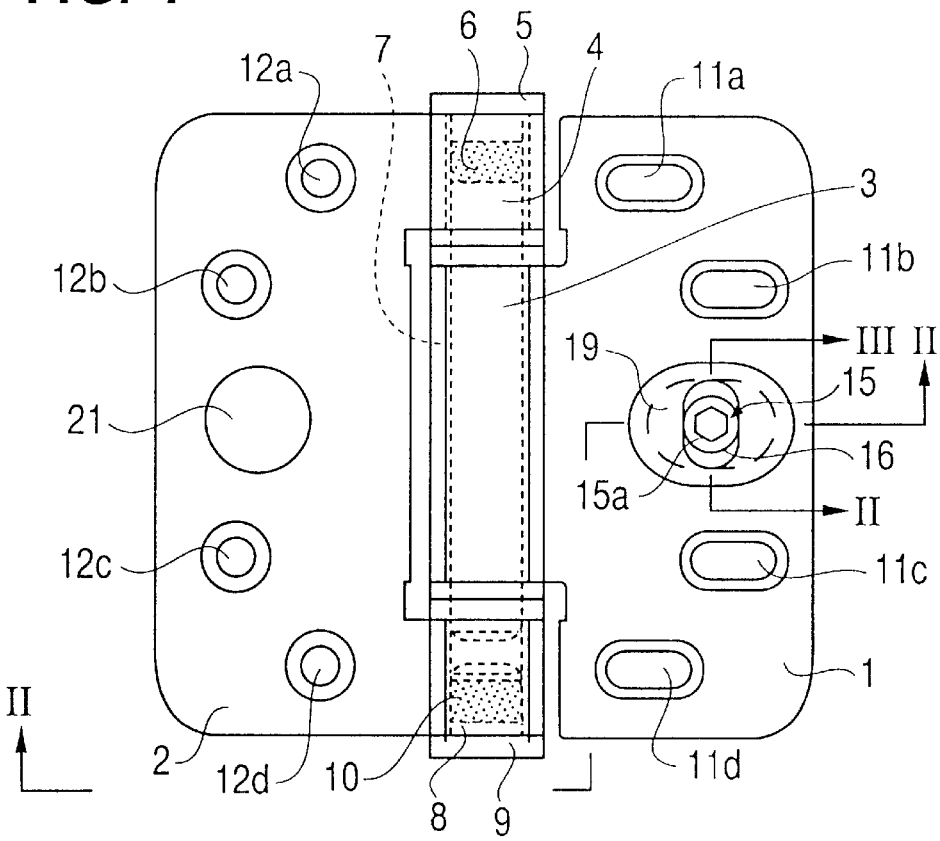
FIG. 1 shows a first embodiment of the hinge according to the invention whose hinge wing is only adjustable transversely to the axis of rotation of the hinge.
Figure 3:
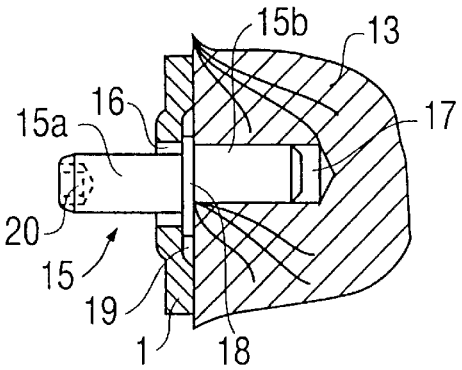
FIG. 3 shows a section along line III—III in FIG. 1.

The hinge according to FIGS. 1 to 4 comprises two hinge wings 1 and 2, which are pivotable relative to one another about an axis of hinge rotation 3. The axis is defined by a hinge bolt 4 with a flat head 5 and a knurled zone 6. In the hinge wings 1 and 2 are provided synthetic material cases 7 that serve as bearings for the hinge bolt 4. Into the lower synthetic material case 7 is inserted a plug 8 with a flat head 9 and a knurled zone 10.

The hinge wings 1 and 2 can each be fastened via fastening screws (not shown) to a hinge holder 13 or 14. These hinge holders 13, 14 are, for example, a door and the associated door frame or a similar structure. To receive the fastening screws the hinge wings 1 and 2 comprise either longitudinal bores 11*a*, 11*b*, 11*c* and 11*d* or circular bores 12*a*, 12*b*, 12*c* and 12*d*, respectively.

To adjust the hinge wing 1 transversely to the axis of hinge rotation 3, an adjusting pin 15 is provided whose pin ends 15*a* and 15*b* are disposed eccentrically with respect to one another and are rotatably supported in either receiving bore 16 of the hinge wing 1 or receiving bore 17 of the hinge holder 13 associated with the hinge wing 1.

Figure 4:
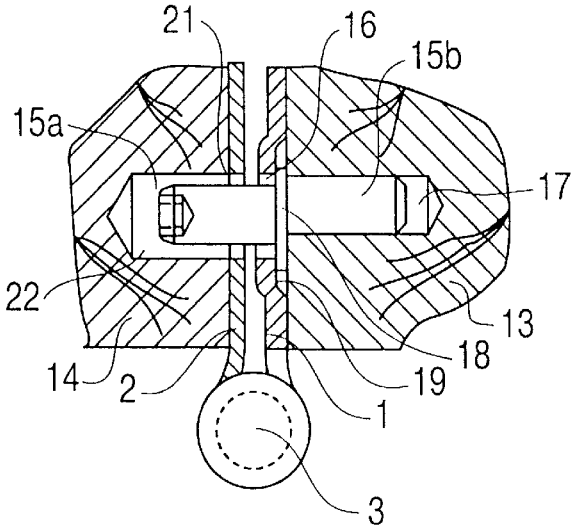
FIG. 4 shows the adjusting pin from FIGS. 1 to 3 with the hinge wings folded together and after installation.

According to FIG. 4 the eccentricity of the pin ends 15*a* and 15*b* is usefully dimensioned smaller than the radius of the adjusting pin 15. The adjusting pin 15 is provided between its two pin ends 15*a* and 15*b* with an annular flange 18 which, after installation, is nondisplaceably supported in a bearing depression 19 of the hinge wing 1. The bearing depression 19 is aligned with the receiving bore 16. The bearing depression 19 is elongated transversely to the axis of hinge rotation 3, and is produced by a stamping process. The receiving bore 16, in turn, is formed as a bore elongated in the direction of the axis of hinge rotation 3.

The pin end 15*a* is rotatably supported in the receiving bore 16 and projects from it, and is provided with a hexagonal recess 20 or the like for the placement of a turning tool. When the hinge is folded together, the pin end 15*a* projects through a penetration bore 21 of the other hinge wing 2 and into a receiving bore 22 of the hinge holder 14 associated with the hinge wing 2, and thereby acts as a mechanism hindering break-ins. The penetration bore 21 and the receiving bore 22 have a diameter approximately equal to the length of the bore 16 along its major axis. The adjusting pin 15 is disposed centrally in the hinge wing 1 when viewed in the direction of the axis of hinge rotation 3.

With this adjustment device the hinge wing 1, and with it the hinge holder 13, can be adjusted transversely to the axis of hinge rotation 3. This results in a considerably simpler adjustment of the hinge holder 13 with respect to the other holder 14. The holder 13 can be a door while the holder 14 can be a door frame.

Figure 5:
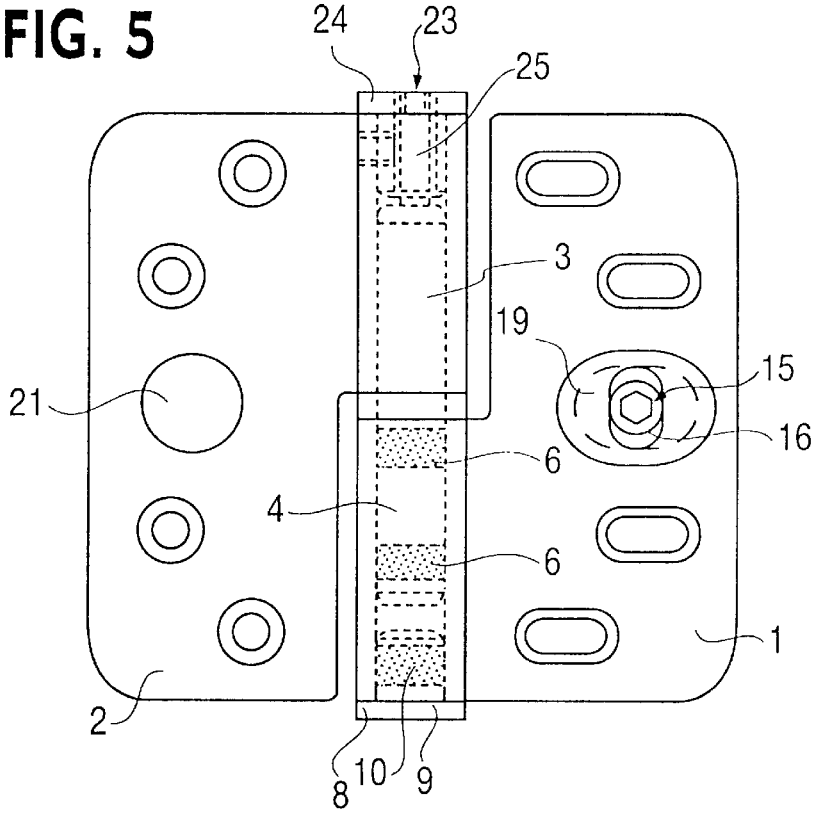
FIG. 5 shows a different embodiment of the hinge according to the invention which is additionally provided with an adjustment element for adjusting the hinge wings in the direction of the axis of rotation of the hinge.

The hinge according to FIG. 5 differs from the hinge according to FIGS. 1 to 4 only in that the hinge wings 1 and 2 are also adjustable in the direction of the axis of hinge rotation 3. For this purpose there is provided an adjustment device 23 comprising two parts 24 and 25, one screwed into the other. The part 24 is rotatably supported in the hinge wing 2. The part 25 is supported against the hinge bolt 4 which, in turn, is held nondisplaceably in hinge wing 1. By rotating part 24 with the aid of a suitable tool, the parts 24 and 25, and thus hinge wings 1 and 2, are displaceable relative to one another in the direction of the axis of hinge rotation 3. The hinge according to FIG. 5 is otherwise identical to the hinge according to FIGS. 1 to 4. Corresponding parts are denoted by identical reference numbers.

To adjust the hinge wing 1 transversely to the axis of hinge rotation 3, the adjusting pin 15 is rotated by a screw driver or a similar tool until the desired setting has been attained.

In the installed state, the adjusting pin 15 is held securely by the annular flange 18 that is supported nondisplaceably in the bearing depression 19. It is, in addition, always readily accessible since the pin end 15a with the hexagonal recess 20 is disposed on the front face on the hinge wing 1. During the rotation of the adjusting pin 15 the pin end 15*a* can move freely in the elongated receiving bore 16. This makes it possible to adjust the hinge wing 1 after installation of the hinge, with the fastening screws remaining screwed into the hinge holder 13.

The adjusting pin 15 is implemented in the described embodiment example such that a considerable portion of its pin end 15*a* projects from the receiving bore 16. But it is also possible within the scope of the invention to construct the pin end 15*a* to be shorter, and specifically of such a length that it is still securely rotatably supported in the receiving bore 16. This makes the penetration bore 21 in the hinge wing 2 as well as the receiving bore 22 in its hinge holder 14 superfluous, and thus, this eliminates the effect of the adjusting pin 15 as a break-in hindrance in accordance with the embodiment of FIGS. 1 to 4, in which the pin end 15*a*, in the folded-together state of the hinge wings 1 and 2, projects deeply into the receiving bore 22 of the hinge holder 14.

The invention has been sufficiently illustrated by the above explained embodiments. The adjusting pin 15 permits the adjustment of the hinge wing transversely to the axis of hinge rotation. But the adjusting pin could also be designed such that it permits an adjustment longitudinally or at an angle between 0 to 90° to this axis of hinge rotation. For this purpose the elongated receiving bore 16 and the other elongated bores in the hinge wing would have to be offset by 90°, or by a different angle, with respect to the version represented in FIG. 1. In principle, this elongated receiving bore and the other elongated bores could comprise cross slots extending transversely and longitudinally to the axis of rotation.

What is claimed is:

1. A hinge comprising:

first and second hinge wings pivotable relative to one another about a pivot axis and respectively connectable to first and second supporting structures, with at least one of said first and second hinge wings having a receiving bore extending therethrough; and an adjusting pin having first and second ends that are eccentrically disposed relative to one another, with said adjusting pin being insertable into said receiving bore such that when said first and second hinge wings are connected to the first and second structures, respectively, said adjusting pin is disposed transversely to the pivot axis whereby said second end of said adjusting pin is received within an opening in the one of the first and second supporting structures to which said at least one of said first and second hinge wings is connected, such that rotation of said adjusting pin causes movement of said at least one of said first and second hinge wings relative to the pivot axis.

2. The hinge according to claim 1, wherein the other of said at least one of said first and second hinge wings has a penetration bore extending therethrough, such that when said first and second hinge wings are connected to the first and second supporting structures, respectively, pivoting of said first and second hinge wings relative to one another about the pivot axis results in said first end of said adjusting pin passing through said penetration bore, whereby said first end of said adjusting pin is receivable within an opening in the one of the first and second supporting structures to which said other of said at least one of said first and second hinge wings is connected.

3. The hinge according to claim 2, wherein said first end of said adjusting pin is provided with a recess for receiving a turning tool.

4. The hinge according to claim 3, wherein said recess is hexagonal in shape.

5. The hinge according to claim 4, wherein said adjusting pin includes a flange between said first and second ends, and wherein said at least one of said first and second hinge wings includes a depression aligned with said receiving bore, such that when said first and second hinge wings are connected to the first and second supporting structures, respectively, said flange is received within said depression.

6. The hinge according to claim 5, wherein said receiving bore is an elongated bore having its major axis disposed generally parallel to the pivot axis.

7. The hinge according to claim 4, wherein said penetration bore has a diameter that is approximately equal to a length of said receiving bore.

8. The hinge according to claim 4, wherein said receiving bore extends centrally through said at least one of said first and second hinge wings.

9. The hinge according to claim 4, wherein said at least one of said first and second hinge wings further includes elongated bores each having its major axis disposed generally transversely to the pivot axis.

10. The hinge according to claim 4, wherein said first and second hinge wings are adjustable relative to one another along the pivot axis.

11. The hinge according to claim 4, wherein said receiving bore is an elongated bore having its major axis disposed generally parallel to the pivot axis, such that rotation of said adjusting pin causes movement of said at least one of said first and second hinge wings in a direction generally transverse to the pivot axis.

12. The hinge according to claim 4, wherein said receiving bore is an elongated bore having its major axis disposed generally transverse to the pivot axis, such that rotation of said adjusting pin causes movement of said at least one of said first and second hinge wings in a direction generally parallel to the pivot axis.

13. The hinge according to claim 4, wherein said receiving bore is an elongated bore having its major axis disposed at an angle between 0 and 90° relative to the pivot axis, such that rotation of said adjusting pin causes movement of said at least one of said first and second hinge wings in a corresponding angular direction relative to the pivot axis.

14. The hinge according to claim 1, wherein said adjusting pin includes a flange between said first and second ends, and wherein said at least one of said first and second hinge wings includes a depression aligned with said receiving bore, such that when said first and second hinge wings are connected to the first and second supporting structures, respectively, said flange is received within said depression.

15. The hinge according to claim 14, wherein said receiving bore is an elongated bore having its major axis disposed generally parallel to the pivot axis.

16. The hinge according to claim 1, wherein said penetration bore has a diameter that is approximately equal to a length of said receiving bore.

17. The hinge according to claim 1, wherein said receiving bore extends centrally through said at least one of said first and second hinge wings.

18. The hinge according to claim 1, wherein said at least one of said first and second hinge wings further includes elongated bores each having its major axis disposed generally transversely to the pivot axis.

19. The hinge according to claim 1, wherein said first and second hinge wings are adjustable relative to one another along the pivot axis.

20. The hinge according to claim 1, wherein said receiving bore is an elongated bore having its major axis disposed generally parallel to the pivot axis, such that rotation of said adjusting pin causes movement of said at least one of said first and second hinge wings in a direction generally transverse to the pivot axis.

21. The hinge according to claim 1, wherein said receiving bore is an elongated bore having its major axis disposed generally transverse to the pivot axis, such that rotation of said adjusting pin causes movement of said at least one of said first and second hinge wings in a direction generally parallel to the pivot axis.

22. The hinge according to claim 1, wherein said receiving bore is an elongated bore having its major axis disposed at an angle between 0 and 90° relative to the pivot axis, such that rotation of said adjusting pin causes movement of said at least one of said first and second hinge wings in a corresponding angular direction relative to the pivot axis.

* * * * *